US005379832A

United States Patent [19]

Dempsey

[11] Patent Number: 5,379,832

[45] Date of Patent: Jan. 10, 1995

[54] SHELL AND COIL HEAT EXCHANGER

[75] Inventor: Jack C. Dempsey, Brown City, Mich.

[73] Assignee: Aqua Systems, Inc., Hampton Falls, N.H.

[21] Appl. No.: 94,941

[22] Filed: Jul. 20, 1993

Related U.S. Application Data

[63] Continuation-in-part of Ser. No. 837,283, Feb. 18, 1992, Pat. No. 5,228,505.

[51] Int. Cl.[6] ..... F28B 1/02; F25B 39/04; F25B 39/02

[52] U.S. Cl. ..... 165/110; 165/132; 165/160; 165/163; 62/506; 62/324.1

[58] Field of Search ..... 165/132, 163, 110, 160; 62/513, 509, 506, 324.1

[56] References Cited

U.S. PATENT DOCUMENTS

| | | | |
|---|---|---|---|
| 2,613,513 | 10/1952 | Shields . | |
| 2,668,420 | 2/1954 | Hammell . | |
| 2,668,692 | 2/1954 | Hammell . | |
| 2,751,761 | 6/1956 | Borgerd . | |
| 3,269,135 | 8/1966 | Chubb et al. . | |
| 3,545,228 | 12/1970 | Dinger et al. . | |
| 4,365,483 | 12/1982 | Binger . | |
| 4,495,989 | 1/1985 | Sievers . | |
| 4,530,219 | 7/1985 | Aleksandrow | 62/513 |
| 4,858,584 | 8/1989 | Bridgeman | 165/163 |
| 4,865,124 | 9/1989 | Dempsey | 165/163 |
| 5,088,192 | 2/1992 | Dempsey | 29/890.037 |

FOREIGN PATENT DOCUMENTS 2495754 12/1980 France .

*Primary Examiner*—Albert W. Davis, Jr.
*Attorney, Agent, or Firm*—Brooks & Kushman

[57] ABSTRACT

The heat exchanger is made up of a shell having a coaxial tubular outer and inner wall with end plates attached thereto to enclose a tubular shell cavity provided with an inlet and outlet for a first fluid. Within the shell cavity is a spiral coil of tubing through which flows a second fluid. The coil is wound helically about the axis of the shell and sized to fit the inner and outer walls with limited radial clearance. The coils are axially spaced from one another to define a spiral flow path within the shell cavity for the fluids to first flow. The radial and axial clearance establish a spiral flow path and an axial flow path which are relatively sized to cause the first fluid to travel in a spiral motion, thereby enhancing heat transfer between the first and second fluids. Also, an enclosed central receiver, include communication with the shell cavity, may be formed within the inner tubular wall which serves as a fluid accumulator or reservoir.

14 Claims, 6 Drawing Sheets

SHELL AND COIL HEAT EXCHANGER

CROSS REFERENCE TO RELATED APPLICATION

This application is a continuation-in-part of prior application Ser. No. 07/837,283 filed on Feb. 18, 1992 now U.S. Pat. No. 5,228,505 by Jack C. Dempsey, and entitled "Shell and Coil Heat Exchanger".

TECHNICAL FIELD

This invention relates to heat exchangers and more specifically shell and coil heat exchangers for transferring heat between two fluids.

BACKGROUND ART

Heat exchangers of a shell and coil design have been used for many years in a variety of applications where it is desired to transfer energy between two fluids. Shell and coil heat exchangers are frequently used in refrigeration systems and heat pumps. Shell and coil heat exchangers can be fabricated into a compact unit capable of withstanding relatively high pressure.

Shell and coil heat exchangers are typically mounted vertically, i.e., the axis about which the coil is wound is perpendicular to the ground. With a vertical shell having a gas vapor mixture, the gas will tend to accumulate at the bottom. The flow of the fluid in the shell is generally axial flowing from one end to the other and circulating about the coils of tubing within the shell cavity.

In order to minimize the volume within the shell, a central tubular insert may be provided which falls within the helical coil. This is particularly useful in refrigeration systems and heat pumps so that the quantity of refrigerant may be minimized. Example of a shell and coil heat exchanger having an inner shell to minimize shell cavity volume is shown in U.S. Pat. No. 2,668,692 and companion U.S. Pat. No. 2,668,420. In spite of the inner shell, a significant disadvantage of the shell heat exchangers are the large volume of the shell cavity relative to the volume of the liquid within the coiled tubing.

SUMMARY OF THE INVENTION

An object of the invention is to achieve maximum heat transfer rate and overall efficiency while minimizing the size of the shell and coil.

Another object of the invention is to minimize the volume of fluid within the shell and coil cavities.

A further object of the invention is to develop a heat exchanger which performs satisfactorily in both the vertical and horizontal positions.

Yet another object is to provide a heat exchanger having a central receiver for accumulation condensed refrigerant so that coils in the heat exchanger are not flooded.

The present invention is directed to a heat exchanger and method of forming same. The heat exchanger is made up of a shell which has a coaxial tubular outer and inner wall with end plates attached thereto to enclose a tubular shell cavity provided with an inlet and outlet for a first fluid. Within the shell cavity is a spiral coil tubing wound helically about the axis of the shell and sized to fit between the inner and outer shell walls with limited radial clearance. The spiral coil is provided with a plurality of windings axially spaced from one another to define a spiral flow path within the shell cavity for the first fluid. The radial clearance between the spiral coil and shell inner and outer walls is sized such that the first fluid travels in a spiral motion to enhance the heat transfer between the first fluid and the shell cavity and a second fluid flowing within the spiral coil. A dual spiral helical coil assembly for use in the heat exchanger may be manufactured using a method made up of the following steps: Winding a first tube spirally about a mandrel having a large diameter region and a small diameter region. Winding a second tube spirally in a similar manner, both tubes having an axial spacing between windings. The first and second coils are then interwound so that the small diameter region of each coil is nested within the large diameter region of the opposite coil. The two coils are then depressed axially to deform the coils into a small compact unit with reduced axial spacing between the windings.

Also a heat exchanger is disclosed which has a central receiver within the inner tubular wall to accumulate liquid refrigerant.

The principal advantage of the invention is that the heat exchanger has a low enough shell volume so that it works very efficiently in a reverse flow heat pump having a heating and cooling cycle. Another advantage of the invention is that the fluid within the shell flows in a substantially spiral path so that true counterflow can be achieved resulting in maximum heat transfer.

BEST MODE FOR CARRYING OUT THE INVENTION

Figure 1:
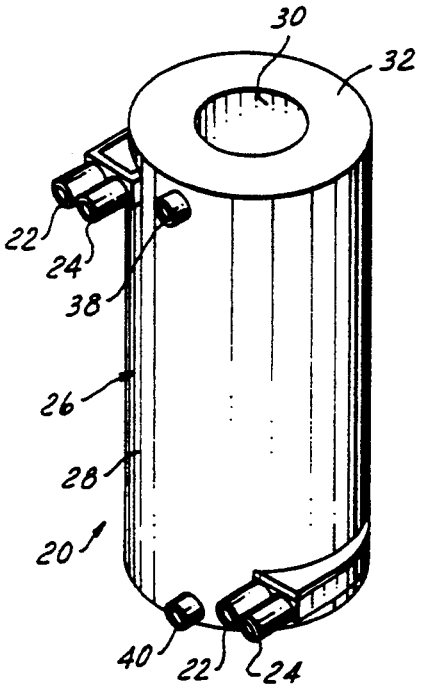
FIG. 1 is a perspective view of the heat exchanger.
Figure 2:
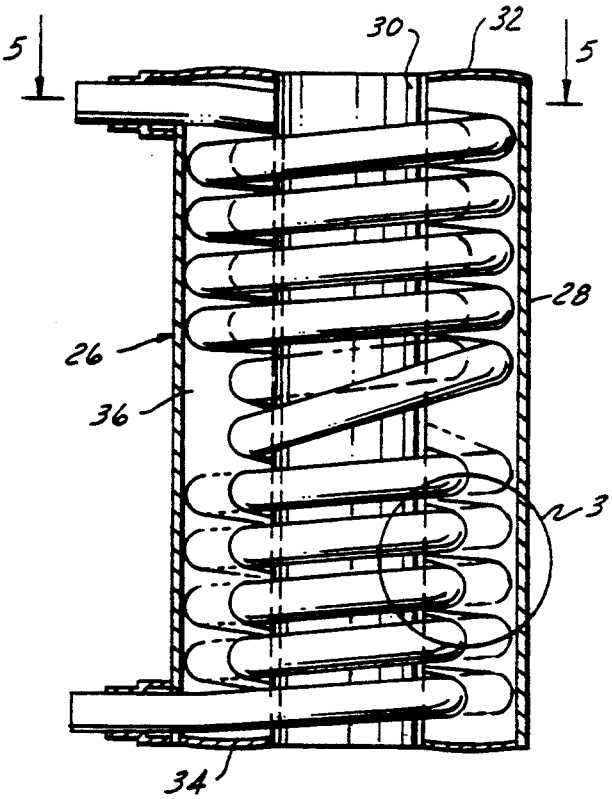
FIG. 2 is a side elevation of the heat exchanger with a portion of the shell cut away.

With reference to the drawings, four preferred embodiments of the heat exchanger will be described in detail as well as a method of forming a helical coil.

Embodiment I

A first embodiment of the heat exchanger is shown in FIGS. 1 through 5. The heat exchanger 20 is provided with a pair of spiral coils of tubing 22 and 24 and the shell assembly 26 made up of the outer tubular wall 28, inner tubular wall 30 and first and second end plates 32 and 34. Shell assembly 26 encloses a tubular shell cavity 36 which is symmetrical about the axis of the heat exchanger assembly. At the upper end of the shell assembly is a first inlet-outlet fitting 38 and at the opposite end of the shell assembly is the second inlet-outlet fitting 40. Each fitting 38 and 40 communicates with the shell cavity 36 and provide means for admitting and means for removing a first fluid from the shell cavity. Which fitting acts as an inlet and which fitting acts as an outlet will vary depending on the application or the mode of operation in the case of the reverse cycle heat pump where the direction of flow may vary depending on whether the unit is heating or cooling.

Figure 4:
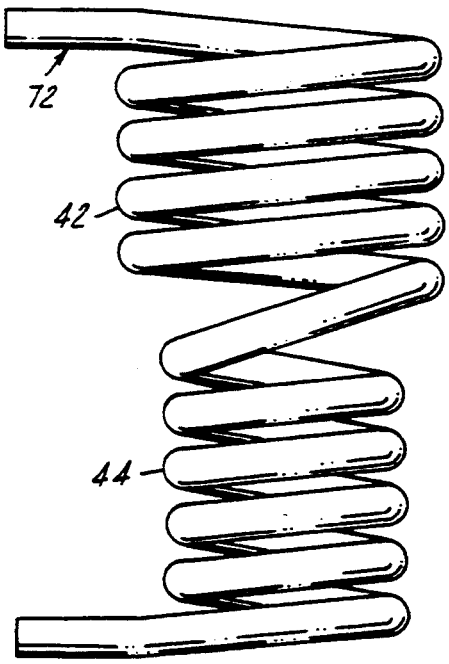
FIG. 4 is a side elevation of a spiral coil.
Figure 3:
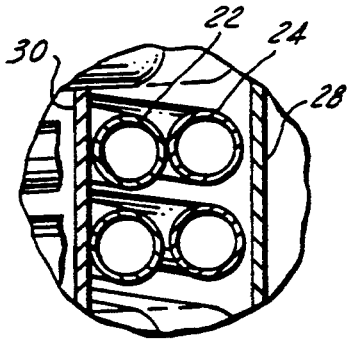
FIG. 3 is a fragmentary cross-sectional view of a portion of the heat exchanger.

Within the shell cavity lies the first and second spiral coils 22 and 24. Second spiral coil 24 is shown in dotted lines in FIG. 2 so the two coils may be distinguished. Both coils are similar in shape as shown in FIG. 4. Each has a large diameter region 42 and a small diameter region 44 both of which are helically wound about the center axis of heat exchanger assembly. The small diameter section of each coil is located within the large diameter section of the opposite coil so that the two coils are nested together to form a compact assembly.

The small diameter section of the coil fits relatively closely to the inner tubular wall 30 of the shell assembly and the outer periphery of the large diameter of the coil fits relatively close to the outer tubular wall 28 of the shell assembly. Each of the spiral coils has a plurality of windings located generally adjacent a corresponding winding in the opposing coil so that the combined radial dimension of the two windings substantially occupy the space of the cavity between the inner and outer walls. The radial clearance between the inner and outer wall and the pair of coiled windings is carefully controlled to restrict the flow of a first fluid flowing through the shell cavity. The axial spacing of the coil windings is also very carefully controlled to define a spiral flow path within the shell cavity for the first fluid. The radial clearance and axial spacing of the coils and the shell cavity are relatively sized so that the first fluid within the shell cavity travels in a spiral motion to enhance the heat transfer between the first fluid within the shell cavity and the second fluid traveling with the coils.

Two spiral coils of tubing are used in the first embodiment shown in FIGS. 1-5 in order to maximize the surface to volume ratio as two tubes with a given total cross-sectional area having much greater wall area than a single tube of equal cross-sectional area. In typical operation the inlets and outlets of coils 22 and 24 will be connected together with a "Y"-shaped yoke to provide a single input and a single output. Copper has been found to be a preferred material for the spiral coils. Ideally, the copper tubing will have its periphery knurled and its internal surfaces rifled so that the surface area can be increased. A tube having an augmented wall surface of this design is described in detail in U.S. Pat. No. 4,402,359 which is incorporated herein by reference. Tubing with knurled exterior and rifled interior is commercially available from Noranda Metal Industries, Inc. of Newton, Conn. The tubes having knurled exteriors are particularly advantageous in the present invention in that when a coil contacts an adjacent coil or the wall of the shell, flow is not completely obstructed in the axial direction since fluid can flow between the raised knurled protrusions thereby most effectively using the entire heat transfer surface of the tubing. Alternatively, S/T TRUEFIN®, an augmented finned tube made by Wolverine, P.O. Box 2202, Decatur, Ala. 35602, may be used to form the coils.

Figure 20:
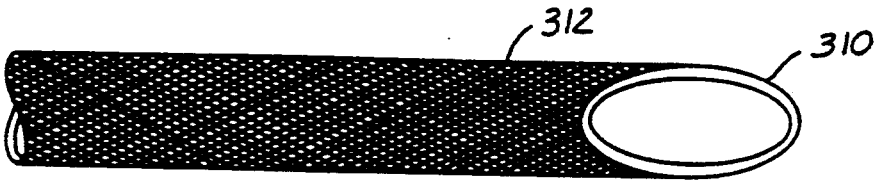
FIG. 20 is a perspective view of an augmented tube.

Referring to FIG. 20, there is shown a heat transfer tube 310 having a plurality of integral radially extending pyramid-fins 312 formed in its outer surface. The density of the pyramid-fins is between 80 and 500 pyramid-fins per square inch and the height of the pyramid-fins is between 0.015 inch for a pyramid-fin density of 500 pyramid-fins per square inch and 0.040 inch for a pyramid-fin density of 80 pyramid-fins per square inch. The series of threads intersect each other at 60° so as to form a herringbone or diamond pattern. The threads are in the range of 12 to 30 TPI, preferably about 20 TPI. The heights of the pyramid-fins formed is between about 0.037 inch at 12 TPI and about 0.015 inch at 30 TPI. The preferred height of the pyramid-fins is about 0.022 inch at 20 TPI.

Figure 21:
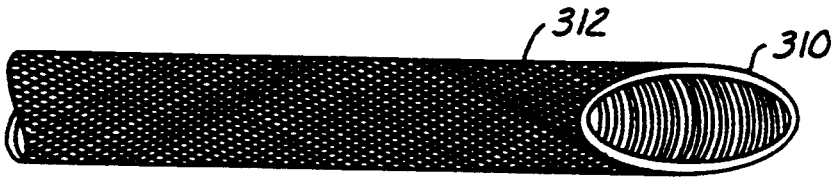
FIG. 21 is an alternative form of augmented tube shown in FIG. 20.
Figure 22:
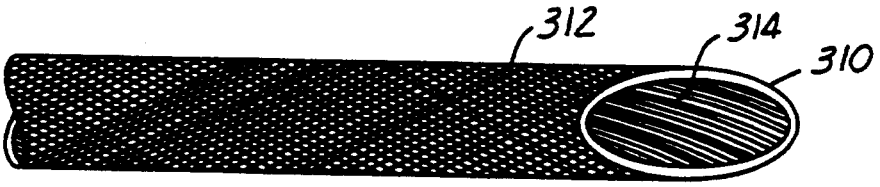
FIG. 22 is another alternative of the augmented tube shown in FIG. 20.

When the pyramid-fins are formed on a tube of relatively small thickness, the heat transfer enhancement pattern will extend through the thickness of the tube wall, as shown in FIG. 21, so as to form a doubly augmented tube. If the tube wall is thick enough, or if a smooth mandrel is placed inside the tube during formation of the external heat transfer enhancement pattern, then the inside of the tube will remain smooth. The inside of the tube may then be provided with internal fins 314 such as shown in FIG. 22 of the drawings. These fins may be formed prior to making the outside pyramid-fins or at the same time by pressing the tube during knurling onto a mandrel placed inside the tube and having suitable grooves for forming the fins. The helix angle of the internal fins is between 0° and 90°, preferably between 15° and 45° with respect to the longitudinal axis of the tube.

Figure 5:
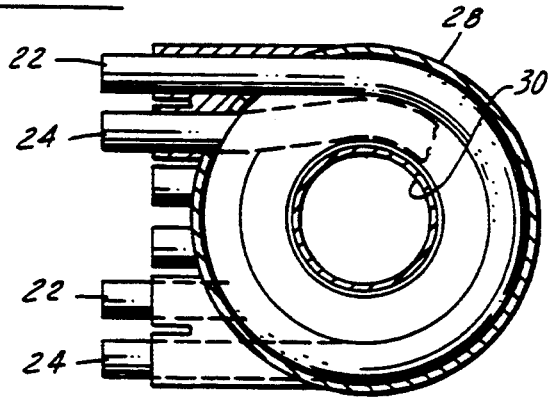
FIG. 5 is a top view of the heat exchanger with the top end cut away.
Figure 6:
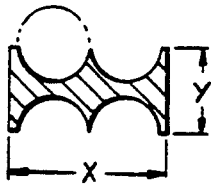
FIG. 6 is a diagram of the spiral flow path of the heat exchanger in the first embodiment of the invention.

FIG. 6 shows a sectional view of the spiral flow path formed between the tubes and inner and outer shell walls. The axial spacing of the tube coils is shown as dimension Y and the spacing between the inner and outer shell walls is shown as dimension X. The cross-hatched area defining the spiral flow path is an area equal to X times Y minus twice the tube area, i.e. $X*Y-\pi DT^2/2$ where DT equals the tube diameter. The minimum axial flow area in the shell is equal to the area of the shell minus the area of the tubes in the plan view. As shown in FIG. 5, the axial flow path consists of three small circular paths. The clearance between the two tubes and between the tubes and shell wall is shown enlarged in FIGS. 3 and 5 for ease in understanding. The actual axial clearance between the coils and the wall may be 0.005 inch or less, therefore, the axial flow area can be approximated by multiplying the axial clearance times the perimeter of each of the circular flow paths so that the minimum axial flow area will equal $AX*3\pi/2(D1+D2)$ where D1 equals the outer diameter of the inner tubular wall, D2 equals the inner diameter of the outer tube wall and AX equals the axial clearance. The actual axial clearance may be slightly greater than that described by the preceding equation since the outer periphery of the coil is knurled or finned thereby giving it a slightly smaller effective diameter than that measured across the outside diameter of the tube. In Example 4 below, the calculated axial clearance is zero since the tubes fit line to line within the shell. Even in that extremely tight example there will be some axial flow between the knurls or fins thereby allowing effective utilization of the entire tube surface area.

In order to achieve a significant spiral flow path for the first fluid in the shell cavity, the axial flow area should not exceed that of the spiral flow path as previously calculated. The relationship between the actual flow area and the spiral flow path can be quantified by an axial clearance ratio which is equal to the axial flow path divided by the spiral flow path area. It is therefore desirable to have an axial clearance ratio below one hundred percent. It is preferred that the axial clearance ratio be maintained below sixty percent. The most preferred axial clearance ratio is between zero to sixty percent depending upon the specific application for the heat exchanger unit. Note that even with the zero axial clearance ratio as previously calculated, there will be some axial flow due to the knurling of the coil tubing. The following examples represent possible heat exchanger embodiments, the first of which has been tested and performed quite satisfactorily.

EXAMPLE 1

| COIL DESIGN | TYPE I |
|---|---|
| X | 1.515 |
| Y | .9375 |
| DT | .750 |
| Spiral Flow Path Area $X * Y - \pi DT^2/2 =$ | .537 |
| $D_1$ | 6.000 |
| $D_2$ | 2.970 |
| Axial Clearance (AX) | .005 |
| Axial Clearance Area $\pi AX (D_1 + D_2)3/2$ | .211 |
| Axial Clearance Ratio | 39% |

EXAMPLE 2

| COIL DESIGN | TYPE I |
|---|---|
| X | 1.5195 |
| Y | .9375 |
| DT | .750 |
| Spiral Flow Path Area $X * Y - \pi DT^2/2 =$ | .542 |
| $D_1$ | 6.000 |
| $D_2$ | 2.961 |
| Axial Clearance (AX) | .0075 |
| Axial Clearance Area $\pi AX(D_1 + D_2)3/2$ | .317 |
| Axial Clearance Ratio | 58% |

EXAMPLE 3

| COIL DESIGN | TYPE I |
|---|---|
| X | 1.512 |
| Y | .9375 |
| DT | .750 |
| Spiral Flow Path Area $X * Y - \pi DT^2/2 =$ | .535 |
| $D_1$ | 6.000 |
| $D_2$ | 2.978 |
| Axial Clearance (AX) | .004 |
| Axial Clearance Area $\pi AX(D_1 + D_2)3/2$ | .169 |
| Axial Clearance Ratio | 32% |

EXAMPLE 4

| COIL DESIGN | TYPE I |
|---|---|
| X | 1.50 |
| Y | .9375 |
| DT | .750 |
| Spiral Flow Path Area $X * Y - \pi DT^2/2 =$ | .523 |
| $D_1$ | 6.00 |
| $D_2$ | 3.00 |
| Axial Clearance (AX) | 0 |
| Axial Clearance Area $\pi AX(D_1 + D_2)3/2$ | 0 |
| Axial Clearance Ratio | 0 |

Use Of Heat Exchanger In Dual Mode Heat Pump

Figure 7:
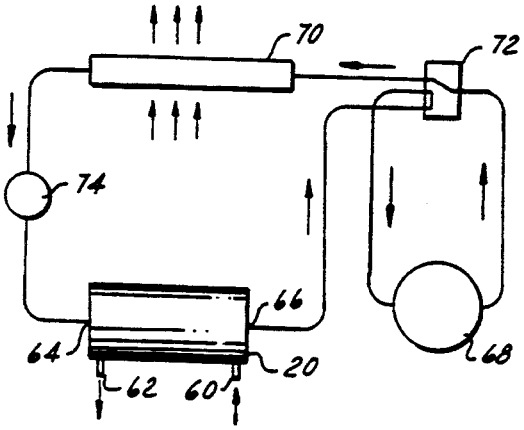
FIG. 7 is a block diagram of a heat pump in the heating mode.
Figure 8:
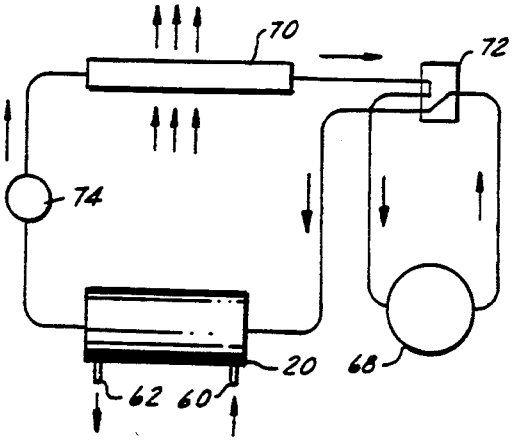
FIG. 8 is a block diagram of a heat pump in the cooling mode.

The heat exchanger described in the first embodiment works quite satisfactorily in a water source heat pump which can be used for both heating and cooling. Schematic diagram of a heat pump in the heating mode and in the cooling mode are shown in FIGS. 7 and 8, respectively. The heat exchanger is depicted by box 20 and is provided with water inlet 60 and water outlet 62. The water circulates through the tubular coil in the heat exchanger unit. In the shell of the heat exchanger is circulated a refrigerant such as Freon ® 22. In the heating mode, refrigerant enters in the outlet 64 and exits the shell cavity through inlet/outlet 66 as the refrigerant is circulated by pump 68 which circulates the Freon ® in a closed loop path through tube and shell heat exchanger 20, tube and fin heat exchanger 70. Heat exchanger 70 transmits energy between the Freon ® and air which is circulated through the heat exchanger by a blower which is not shown in the heating mode and reversing valve 72 and is oriented such that the output of the pump is connected to the tubing vent heat exchanger 70 and the suction side of the pump is connected to a shell and coil heat exchanger.

In the heating mode the shell and coil heat exchanger acts as an evaporator and the tube and fin heat exchanger 70 acts as a condenser. The hot high pressure output of pump 68 flows to tube and fin heat exchanger 70 and is cooled by the flow of air therethrough. Pressure is maintained relatively high and the tube and fin exchanger 70 by expansion valve 74. When the refrigerant flows through expansion valve 74, pressure drops substantially. As a low pressure refrigerant flows into the heat exchanger 20, it absorbs heat from the water circulating through the coils and evaporates. Refrigerant exits the heat exchanger through outlets 66 and passes through reversing valve 72 to the inlet of pump 60 to complete the heating cycle.

Pump 60 is driven by conventional mechanical means such as an electrical motor. Since heat energy is being added or removed from the water circulating through the coil of the heat exchanger, the energy output to the air substantially exceeds the energy consumed by the pump 68 in the heating and cooling modes. In the cooling mode, the reversing valve switches as shown in FIG. 8 so the suction side of the pump is connected to the tube and fin heat exchanger 70 and the outlet of the pump is connected to the shell and coil heat exchanger 20. In the cooling mode the heat exchanger 20 acts as a condenser. The water circulating through the coil cools the refrigerant circulating through the shell cavity. The refrigerant flows through expansion valve 74 and evaporates in the tube and fin heat exchanger 74 to cool the air flowing therethrough.

It has been determined that the heat exchanger of the present design performs quite well in a reverse cycle water source heat pump and is capable of achieving very high efficiency levels in both the heating and cooling modes. Previous heat pump designs tended to optimize performance in one mode that was used most frequently and accepting a lower coefficient of performance in the lesser used mode.

Embodiment II

Figure 9:
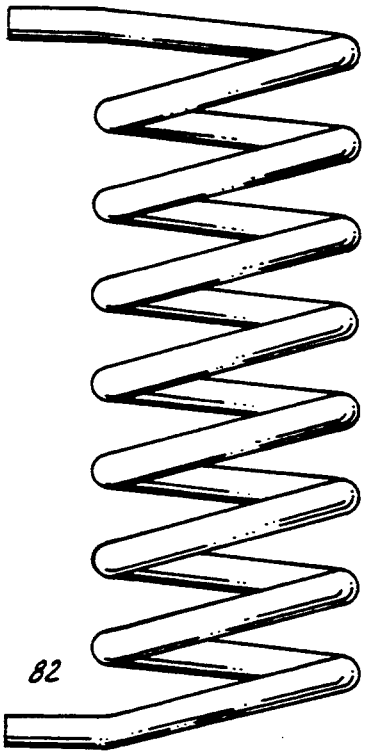
FIG. 9 is a spiral coil from an alternative embodiment of the invention.
Figure 10:
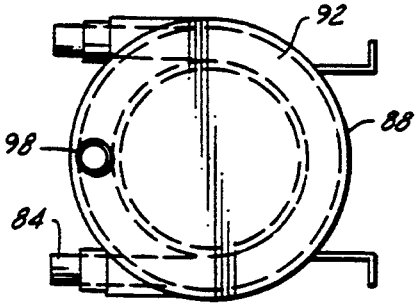
FIG. 10 is a top view of an alternative embodiment of the invention.
Figure 11:
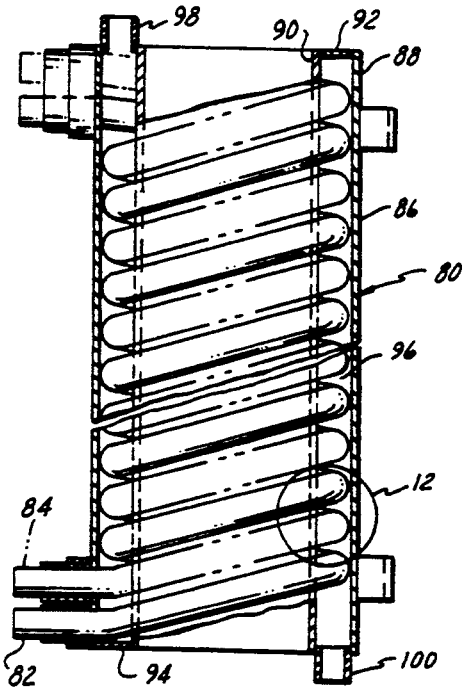
FIG. 11 is a side view of an internal embodiment of the invention with a portion of the shell cut away.

An alternative embodiment of the heat exchanger is shown in FIGS. 9 through 13. In the second embodiment, the heat exchanger assembly 80 is provided with a first and second spiral coil 82 and 84 helically wound about a central axis and having a constant uniform diameter. The two coils are interwoven like a double lead screw as shown in FIG. 11. Each of the individual coils has substantial axial spacing between the plurality of windings as shown in FIG. 9. The coils are identical in structure. The shell assembly 86 is made up of an outer tubular wall 88 and an inner tubular shell wall 90 which are connected by first and second end plates 92 and 94 to define a shell cavity 96. Shell cavity 96 is provided with first and second inlet/outlet fittings 98 and 100 at opposite ends of the shell cavity.

Figure 12:
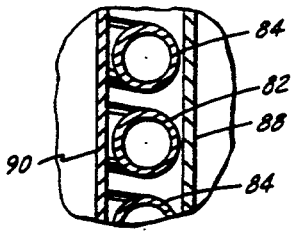
FIG. 12 is an enlarged fragmentary cross-sectional view of the second embodiment of the invention.
Figure 13:
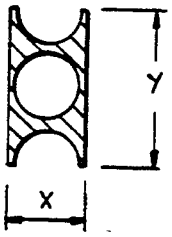
FIG. 13 is a diagram of the spiral flow path of the heat exchanger in the second embodiment of the invention.

A fragmentary cross-sectional side view of a portion of the heat exchanger assembly is shown in FIG. 12. The inner and outer walls of the shell 90 and 88 are spaced apart by a distance slightly greater than the diameter of the coils 82 and 84 thereby providing axial clearance for the flow of the first fluid in the heat exchanger shell. In FIG. 11, coil 84 is drawn in dotted lines to more clearly show that each coil winding is positioned between the windings of the other coil. The spiral flow path in the second embodiment of the invention is shown in FIG. 13. Note dimension y, the distance between coil windings, represents the distance between two windings of the same coil. The equation defining the spiral flow area is the same for the second embodiment as it is for the first. The spiral flow area equals X times Y minus $DT^2/2$. The minimum axial flow area is equal to the axial clearance between the tube and shell wall times the total clearance area length, i.e., axial clearance area equals pi times axial clearance times (D1+D2)3/2. The following are examples of potential designs for heat exchangers of the type shown in the second preferred embodiment:

| EXAMPLE 5 | |
|---|---|
| COIL DESIGN | TYPE I |
| X | .760 |
| Y | 1.6875 |
| DT | .750 |
| Spiral Flow Path Area $X * Y - \pi DT^2/2 =$ | .400 $in^2$ |
| $D_1$ | 6.000 |
| $D_2$ | 4.480 |
| Axial Clearance (AX) | .005 |
| Axial Clearance Area $\pi AX(D_1 + D_2)3/2$ | .165 |
| Axial Clearance Ratio | 41% |

-continued

| EXAMPLE 6 | |
|---|---|
| COIL DESIGN | TYPE I |
| X | .763 |
| Y | 1.6875 |
| DT | .750 |
| Spiral Flow Path Area $X * Y - \pi DT^2/2 =$ | .405 |
| $D_1$ | 6.000 |
| $D_2$ | 4.477 |
| Axial Clearance (AX) | .0065 |
| Axial Clearance Area $\pi AX(D_1 + D_2)3/2$ | .208 |
| Axial Clearance Ratio | 51% |

| EXAMPLE 7 | |
|---|---|
| COIL DESIGN | TYPE I |
| X | .758 |
| Y | 1.6875 |
| DT | .750 |
| Spiral Flow Path Area $X * Y - \pi DT^2/2 =$ | .396 |
| $D_1$ | 6.000 |
| $D_2$ | 4.484 |
| Axial Clearance (AX) | .004 |
| Axial Clearance Area $\pi AX(D_1 + D_2)3/2$ | .128 |
| Axial Clearance Ratio | 32% |

| EXAMPLE 8 | |
|---|---|
| COIL DESIGN | TYPE I |
| X | .760 |
| Y | 1.6875 |
| DT | .750 |
| Spiral Flow Path Area $X * Y - \pi DT^2/2 =$ | .400 |
| $D_1$ | 6.00 |
| $D_2$ | 4.50 |
| Axial Clearance (AX) | 0 |
| Axial Clearance Area $\pi AX(D_1 + D_2)3/2$ | 0 |
| Axial Clearance Ratio | 0 |

Method Of Winding A Coil And Forming Heat Exchanger

Figure 14:
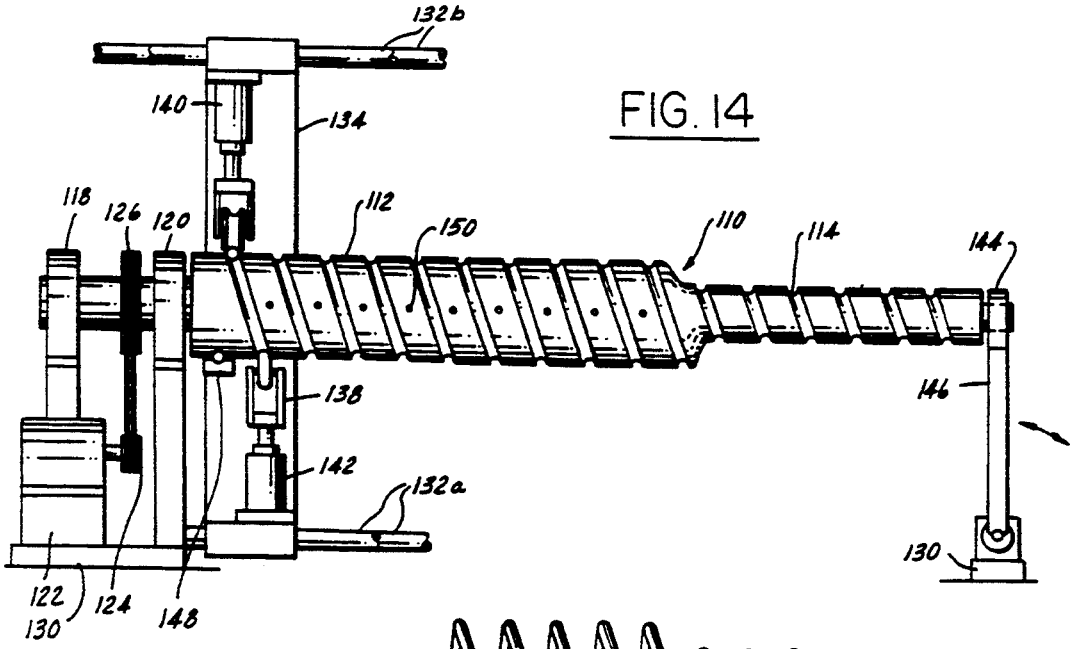
FIG. 14 is a side elevation of an apparatus for forming a spiral coil used in the first embodiment of the invention.

FIG. 14 shows a diagram of a mechanism specifically designed for winding heat exchanger coils. The apparatus has a central mandrel 110 having a large diameter section 112 and a small diameter section 114. The mandrel is provided with a helical semi-circular groove having the same large and small diameter and the same number of turns to get the coil employed in the first embodiment of the invention as shown in FIG. 4. The axial spacing between the grooves where the pitch of the spiral on the mandrel is significantly greater than the finished coil shown in FIG. 4. The semi-circular groove 116 corresponds in diameter in the tube size to be formed into a coil.

Mandrel 110 is pivotably supported on one end by bearings 118 and 120. The mandrel is driven by hydraulic motor 122 which is coupled to the mandrel by sprockets 124 and 126 and chain 128. Bearings 118 and 120 and the hydraulic motor 122 are affixed to an assembly 130. Affixed to frame 130 are guide rods 132(*a*) and 132(*b*) preferably four parallel guide rods are parallel to the axis of the mandrel 110. Sliding axially along the guide rods is subframe 134 which is shown in its left most position in FIG. 14. Mounted on subframe 134 is guide roll 136 and 138 which are pivotably mounted on the ends of hydraulic cylinders 140 and 142. The small end of the mandrel 110 is pivotably supported by the bearing 144 which is affixed to frame 130 so that it can be hinged into and out of cooperation with the mandrel 110 as shown by the arrow in FIG. 14.

Prior to the bending of a coil, a straight length of copper tube of sufficient length to form a coil is selected and filled with sand. The ends of the tube are capped to prevent the sand from escaping. The sand prevents the tube from kinking or collapsing during the bending process. With some thick wall tubing sand is not required. Hydraulic cylinders 140 and 142 are not fully retracted so that guide rollers 136 and 138 are in contact with the mandrel. In the embodiment shown, the mandrel would be rotated 180° so that clamp 148 would be on the top of the mandrel. One end of the tube would then be affixed to the mandrel with claim 148 so that the clamp would be lying in a semi-circular helical groove 116. Hydraulic cylinders 140 and 142 would then be pressurized causing the guide rollers to come in contact with the mandrel. Note that guide roller 136 is provided with a semi-circular groove to cooperate with a tube to be bent. The load exerted by hydraulic cylinders 140 and 142 is substantially equal so that there is minimal bending force exerted on the mandrel. With the tube clamped in place and the guide rolls in position, hydraulic motor 122 is activated to cause the mandrel to rotate counter-clockwise when viewed from the end adjacent the hydraulic motor. As the mandrel rotates the entire subframe assembly 134 with the guide rolls and hydraulic cylinders mounted thereon moves to the right in FIG. 14 traversing the length of the mandrel. As the subframe reached the transition from the large mandrel end 112 to the small mandrel end 114, the hydraulic cylinders 140 and 142 maintain the guide rolls in constant contact with the mandrel.

Figure 15:
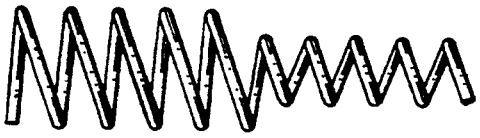
FIG. 15 is a spiral coil prior to compression.

When the desired number of winding have been made, the hydraulic motor stops, hydraulic cylinders are retracted and link 146 is pivoted clockwise out of the way. Clamp 148 holding the coil in place is removed and the hydraulic motor is run with the coil restrained from turning so that the formed coil is screwed off of the mandrel. The formed coil as shown in FIG. 15 is substantially longer than ultimately desired and the axial spacing between the windings is large. The ends of the coil is then uncapped and the sand removed. A second coil is then formed in the identical manner so that the two coils are placed end to end with the small ends of each coil in contact with one another. The one coil is then rotated so that the two coils threadingly interweave with one another so that the small end of one coil become located entirely within the large end of the opposite coil and vice versa.

Figure 16:
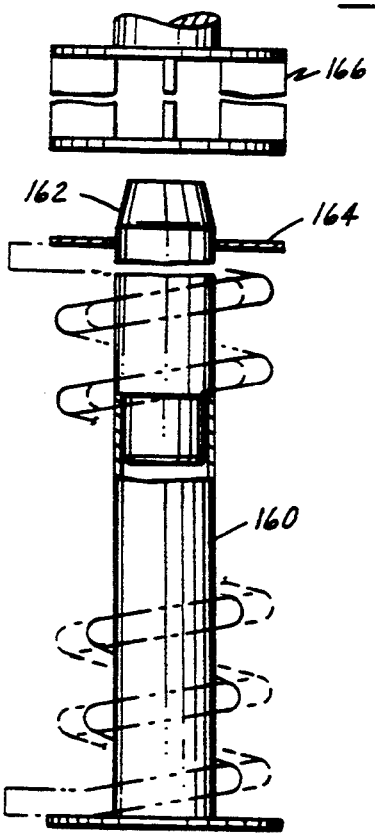
FIG. 16 is an exploded view of the apparatus for compressing a spiral coil assembly.

With the two coils oriented in nested relationship with one another as previously described, they are then pressed to the desired final length using a fixture shown in FIG. 16. The inner shell tubular wall is cut to length and welded to the lower end plate to form inner tube end plate assembly 160. Assembly 160 is placed on a flat surface and guide mandrel 162 is telescopingly inserted therein. The lower end of guide mandrel has a cylindrical section to fit into the inside diameter of assembly 160 and the opposite end of guide mandrel is conically tapered. The inner tube end plate assembly with the guide mandrel installed has an overall length in excess of the length of the coil spring prior to compression. A coil spring pair, interwoven as previously described, is placed over the guide mandrel top plate 164 and is placed thereon and compressed by Ram 166 using a conventional press (not shown). When the top plate 164 has been pressed to the inner tube end plate assembly, the top plate is then tack welded to the inner tube, then the ram and the guide mandrel are removed so that the weld can be completed resulting in a spool-like assembly.

Figure 17:
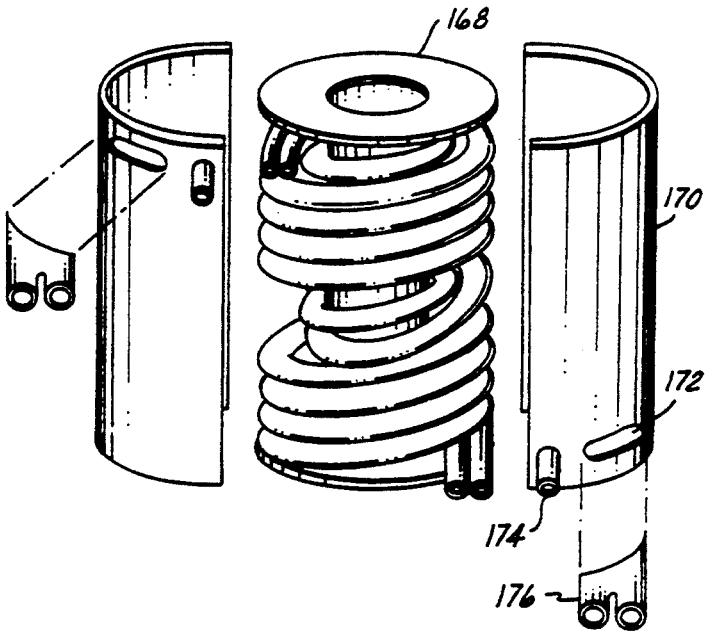
FIG. 17 is a perspective view of the first embodiment of the invention prior to assembly of the shell outer wall.

The spool-like assembly 168 which consists of an inner tube, top and bottom plates, and the coils, are then fitted within the outer shell walls as shown in FIG. 17. The outer shell walls are made up of two identical semi-cylindrical halves 170 which are provided with a slot 172 through which the ends of the coils may project in an inlet/outlet fitting 174. The two semi-cylindrical halves are welded to the top and bottom plates and to each other. Yokes 176(*a*) and 176(*b*) are then welded to the tubes projecting through slot 172 and through the shell in a leak-tight manner. Note that the yokes used have individual outlets for each of the tubes forming the coil assembly, however, it may be more convenient in some instances to have a single outlet. With the yokes welded on, the unit is complete and it is then pressure tested for leaks and attachment brackets are affixed as desired to the outer shell.

The semi-cylindrical shell halves 170 employed in the preferred embodiment of the invention are constructed of steel tubing which has been cut and split. The tubing has an ⅛ inch nominal wall thickness and it is relatively easy to fabricate and weld. In high volume production, it is envisioned that the shell halves could be stamped or rolled with the yoke integrally formed therein.

Embodiment III

Figure 18:
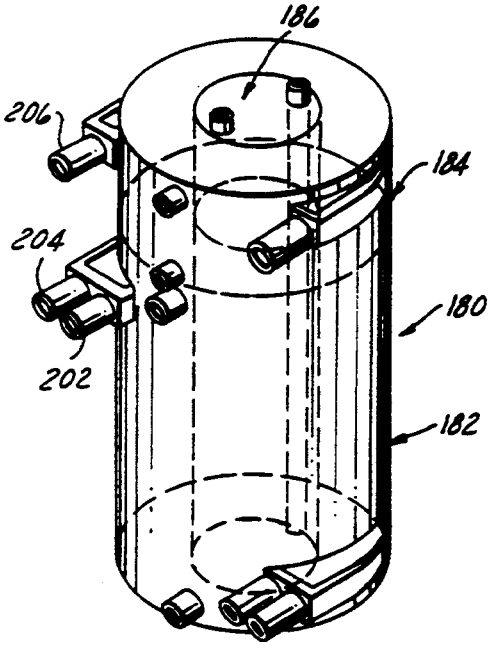
FIG. 18 is a perspective view of another alternative embodiment of the invention.
Figure 19:
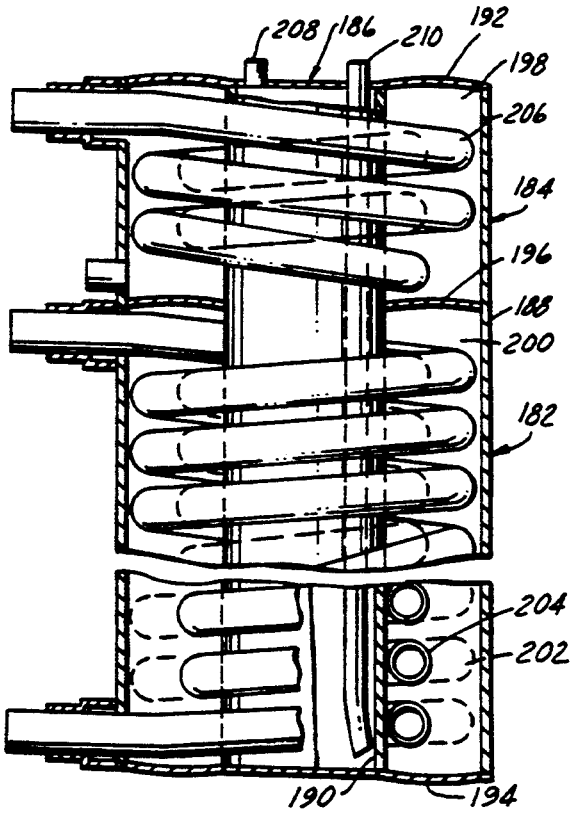
FIG. 19 is a side elevation of the heat exchanger of FIG. 18 with a portion of the shell cut away.

Another alternative embodiment of the invention is shown in FIGS. 18 and 19. This third embodiment 180 consists of a lower shell and coil heat exchanger assembly 182 and upper shell and coil heat exchanger 184 and a central receiver 186. The lower shell and coil heat exchanger 182 is similar in construction to the first embodiment shown in FIGS. 1 through 6 and previously described. The upper shell and coil heat exchanger 184 is mounted coaxially with the lower shell and coil heat exchanger 182 and utilizes a common outer tubular wall 188 and a common inner tubular wall 190. The third embodiment of the invention is provided with a top and bottom end plate 192 and 194 and a divider plate 196 which separates the shell cavity into two independent fluid-tight cavities, upper cavity 198 and lower cavity 200. Within the lower cavity is a pair of spiral coils 202 and 204 and within the upper cavity is a single spiral coil 206.

There are a number of applications when multiple heat exchangers are needed in a system and the third embodiment of the invention shown in FIGS. 18 and 19 provides two heat exchangers in a very small compact assembly. Depending on the situation, divider plate 196 may be left out thereby forming a single shell cavity in which both coil assemblies are housed. Heat exchangers of the present design are useful when a desuperheater is desired. Desuperheaters are also well known in the art and are used in situations when it is desirable from an efficiency standpoint to reduce the presser head pressure by providing supplemental cooling of the refrigerant. The top coil is also quite useful in residential dual mode heat pump systems where hot water will be heated or preheated by the heat pump. In the case of a hot water system or other device used with a potable water, the coil is formed of a double walled tube for the purpose of detecting leaks. Whenever potable water is used in conjunction with a refrigerant, it is important to detect leaks so that Freon® is not introduced into water intended for human consumption. Double wall tube of the type made by Noranda Metal Industries, Inc. of Newton, Conn. 06470 and referred to as a leak-detection double augmented tube (LDDA Series) works quite satisfactorily when combined with an appropriate leak sensor and shut-off or warning system.

The third embodiment of the invention as shown is also provided with an internal receiver 186 defined by inner tube wall 190 and top plate 192 and bottom plate 194. Note that unlike a first embodiment of the invention, the top and bottom plates enclose the ends of the inner tubular wall to form a fluid tight cylindrical cavity. The receiver is provided with an inlet 208 and an outlet 210 projected through the top plate 192. Outlet 210 preferably is in the form of an elongated tube and extending into the receiver cavity and terminating near the bottom thereof. Receivers are quite frequently used in refrigerant systems and the present embodiment provides a compact receiver with minimal extra cost. It is important to note that there will in fact be some heat transfer between the fluid contained in the receiver and the fluid in the shell cavity to heat transfer through the inner shell wall. This heat transfer can be managed in some situations and likewise can be a detriment when no heat transfer is desired. When no heat transfer is desired, it is possible to install an additional receiver tube slightly smaller in outside diameter than the inside diameter of the inner shell wall thereby providing an airgap insulation separating the receiver cavity from the rest of the device.

The coil used in the second embodiment of the invention is somewhat easier to fabricate since both coils are uniform in diameter. The apparatus shown in FIG. 14 used for the winding of the coil used in the first embodiment can also be used to wind the coil in the second embodiment. The mandrel 110 is provided with a series of axially spaced apart drilled and tapped holes 150 for the attachment of clamp 148 at various axial positions along the mandrel. As shown in FIG. 14, clamp 148 is attached in the extreme leftmost position, a position that would be used for forming a constant diameter coil of the type shown in FIG. 9. When a dual diameter coil is to be formed of the type shown in FIG. 15, clamp 148 would be attached to the mandrel 110 and the center portion of the large diameter region so that half of the coil windings will be formed on the large diameter region and half on the small diameter region. Two coils are formed with the desired number of turns and then they are threadingly fitted into each other. It may be necessary to press the unit axially to the desired length to achieve a specific axial tube space, however, pressing may not be necessary if the axial clearance ratio can be adequately established by varying the inside or outside shell wall diameter.

Embodiment IV

Figure 23:
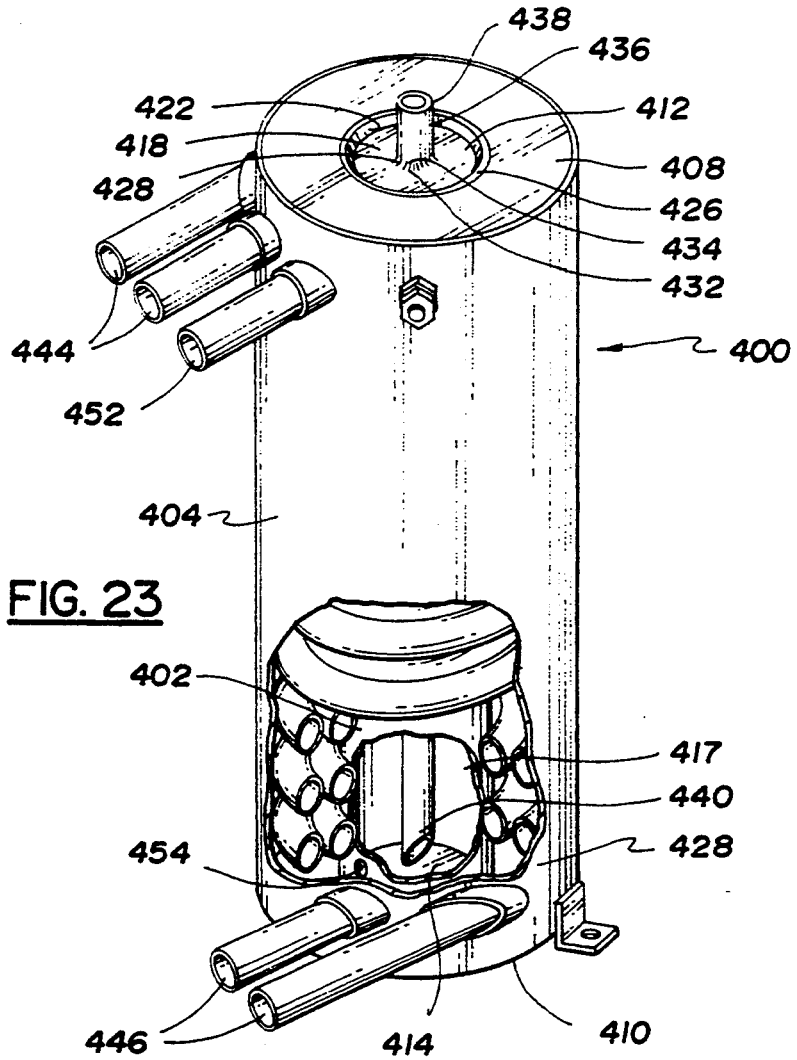
FIG. 23 is an alternative embodiment including a central receiver of a heat exchanger (shown partially in cutaway)
Figure 24:
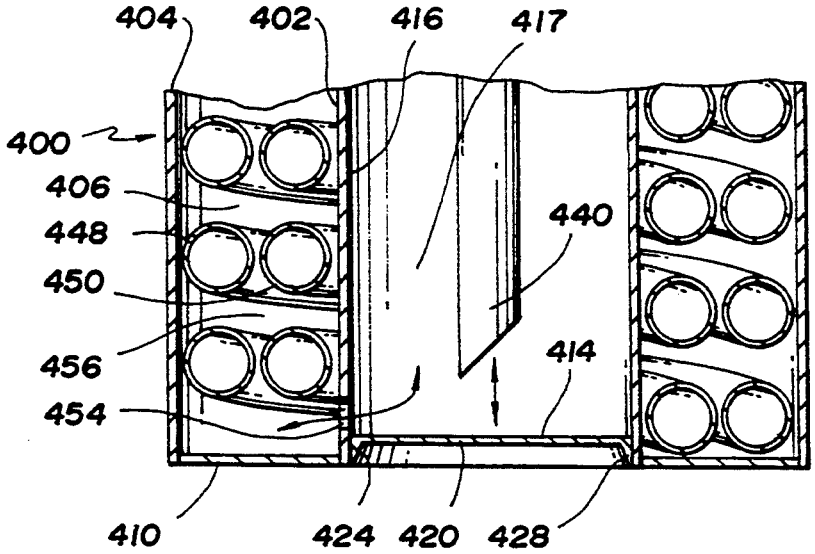
FIG. 24 is a sectional view, partially in cutaway, taken along line 23—23 of FIG. 23.

A fourth embodiment of the invention, heat exchanger 400, is shown in FIGS. 23 and 24. Heat exchanger 400 has an internal receiver cavity 417 generally similar to internal receiver cavity 186 utilized in Embodiment III and shown in FIGS. 18 and 19. Receiver cavity 417, however, is provided with a single external inlet/outlet 438 and an internal orifice 454 between internal receiver cavity 417 and a shell cavity 406. This heat exchanger design is particularly useful in a dual mode heat pump. The use of an internal receiver in this design enables the receiver cavity 417 to be directly connected in series with the shell cavity 406 by way of internal orifice 454. This simplified construction reduces cost, improves heat exchanger performance and minimizes the system's sensitivity to refrigerant charge level.

Heat exchanger 400 has an inner tubular wall 402 and an outer tubular wall 404 defining shell cavity 406 therebetween. Annular first and second end plates 408 and 410 are secured to inner and outer tubular walls 402 and 404 to seal the ends of shell cavity 406. However, rather than having an open central chamber as in the first two embodiments, first and second end caps 412 and 414 are provided to close the ends of the inner tubular wall 402 thereby forming a central receiver 416 defining internal receiver cavity 417.

End caps 412 and 414 are preferably cup-shaped having planar disks 418 and 420 with radially outwardly tapered flanges 422 and 424. Free ends 426 and 428 of flanges 422 and 424 are slightly oversized in diameter as compared to inner tubular wall 402. Consequently, when end caps 412 and 414 are squeezed within inner tubular wall 402, flanges 422 and 424 flex inwardly with the free edges 426 and 428 continuously contacting inner tubular wall 402. Therefore, the welding of flanges 422 and 424 to inner tubular wall 402 is easily performed and the diametrical dimensions on free ends 426 and 428 need not be tightly held as the flanges 422 and 424 flex to fit. As was the case in embodiment III, it is also possible that single end plates can be used to seal both shell cavity 406 and receiver cavity 417.

The center of end cap 412 has an inner flange 432 formed therein defining an aperture 434 which sealingly receives elongated drop-tube 436 therethrough. Drop-tube 436 has a first end or inlet/outlet 438 extending outside central receiver 416 and a second end 440 which is located adjacent end cap 414 at the bottom of receiver cavity 417. Drop-tube 436 replaces inlet/outlets 40 and 174 of the previous embodiments. Inner flange 432 is formed so that when drop-tube 436 is placed through aperture 434, drop-tube 436 is in perpendicular relationship with end cap 412. Drop-tube 436 is sealingly affixed to end cap 412 by silver brazing. Second end 440 is preferably beveled at between 30° and 60°, and most preferably at 45° and terminates adjacent second end cap 414 as shown.

Pairs of inlet/outlet openings 444 and 446 are again located at the top and bottom of outer tubular wall 402 and connect to spiral coils 448 and 450 located within shell cavity 406. Preferably, the arrangement of coils 448 and 450 is similar to that described in the first embodiment employing nested coils with large/small diameter regions. Alternatively, the coil configuration may also include that utilized in the second or third embodiments.

Fluid communication between shell cavity 406 and receiver cavity 417 is provided by orifice 454 formed in inner tubular wall 402. Orifice 454 is located adjacent end cap 414 and near the location where the lowest windings of coils 448 and 450 are initially covered by the second layer of windings of coils 448 and 450, as indicated in FIGS. 23 and 24. An open region 456 is formed beneath the second layers of windings adjacent to where the first windings enters shell cavity 406. Open region 456 is created between end plate 410 and the beginning of the second windings of coils 448 and 450 and allows for the unobstructed flow of refrigerant between shell cavity 406 and receiver cavity 417.

The preferred dimensions of components used in Embodiment IV are shown in Example 9 for heat exchanger 400 of various cooling capacities ranging from 2–6 tons (1 ton=12,000 BTU'S). Inner and outer tubular walls 402 and 404 have respective outer and inner diameters of 3 and 6 inches. Drop-tube 436 has an outer diameter of ½ inch with wall thicknesses of 0.120 inch. In fact, all components ideally are 120 inch in wall thickness. Depending on the desired capacity, different orifice diameters and different heights (outside to outside walls of end plates 408 and 410) of heat exchanger 400 are used. For example, with heat exchanger 400 having a cooling capacity of 5 tons (60,000 BTU'S), orifice 454 is preferably 7/16 inch in diameter. Example 9 lists different dimensions to be used with differing cooling capacities.

ant then travels to pump 72 before returning to heat exchanger 400 where the refrigerant is again cooled.

This fourth embodiment has advantages over the previous embodiments. First, condensed liquid refrigerant has been found to accumulate in receiver cavity 417 rather than around the lower windings of coils 448 and 450 in shell cavity 406. Windings of coils 448 and 450 which are flooded with liquid refrigerant transfer little heat between the refrigerant and the water in shell cavity 406 and coils 448 and 450. Accordingly, the flooding of the lower windings of coils 448 and 450 in shell cavity 406 effectively removes these coils from the heat transfer process and the efficiency of heat exchanger 400 is reduced. By allowing the liquid to accumulate in receiver cavity 417 rather than in shell cavity 406, fewer if any of the windings of coils 448 and 450 are flooded. Consequently, this fourth embodiment provides a more efficient heat exchanger than is found in the previous embodiments.

Another advantage of heat exchanger 400 is that the presence of the central receiver 416 provides a receiver cavity 417 for storing extra refrigerant. Having reserve refrigerant in the heating/cooling system insures that heat exchanger 400 will operate efficiently even if a small amount of refrigerant escapes from the heating-/cooling system.

In the heating or evaporator mode, in a manner similar to that shown in FIG. 7 and with heat exchanger 400 replacing heat exchanger 20, liquid refrigerant enters first end 438 of drop-tube 436, travels to receiver cavity 417, passes through orifice 454 and enters shell cavity 406. While passing upwardly around coils 448 and 450,

EXAMPLE 9

| Capacity (tons*) | Orifice Diameter (inch) | Height (inch) | Outer Tubular Wall** (inner diameter inch) | Inner Tubular Wall** (outer diameter inch) | Inner Diameter Drop-Tube |
|---|---|---|---|---|---|
| 2 | ¼ | 7¼ | 6 | 3 | .260 |
| 3 | 5/16 | 9 | 6 | 3 | .260 |
| 4 | ⅜ | 10¾ | 6 | 3 | .260 |
| 5 | 7/16 | 12½ | 6 | 3 | .260 |
| 6 | ½ | 14¼ | 6 | 3 | .260 |

*1 ton = 12,000 BTU's
** = wall thickness of components including outer and inner tubular wall, end plates, drop tube and end caps are preferably .120" thick.

In operation in the cooling or condenser mode, cool water is introduced into lower inlet/outlet 446, spirals upwardly through coils 448 and 450 and exits out inlet/-outlet 444. Concurrently, heated refrigerant in a gas phase enters inlet/outlet 452, follows the spiral and axial paths defined between the outer diameters of coils 448 and 450 and inner and outer tubular walls 402 and 404, and passes through orifice 454 into receiver cavity 417. As refrigerant passes through shell cavity 406, the gaseous refrigerant loses heat to the water in coils 448 and 450 and liquifies, accumulating in receiver cavity 417. The cooled liquid refrigerant exits heat exchanger 400 through drop-tube 436 and first end or inlet/outlet 438.

Heat exchanger 400 replaces heat exchanger 20 in the heating and cooling modes of FIGS. 7 and 8. Inlet/outlets 64 and 66 of the heat pumps in FIGS. 7 and 8 are respectively connected to inlet/outlet 438 of drop-tube 436 and inlet/outlet 452. In the cooling mode of FIG. 8, the cooled refrigerant passes through expansion valve 74 and reaches heat exchanger 70 where heat from the air is picked up by the refrigerant. The heated refrigerant heat from water in coils 448 and 450 is transferred to the refrigerant in shell cavity 406 causing the refrigerant to evaporate into a gaseous state and transport heat away from heat exchanger 400 through inlet/outlet 452. The heat is then transferred from the refrigerant to the air surrounding heat exchanger 70.

It will be understood, of course, that while the form of the invention herein shown and described constitutes preferred embodiments of the invention, it is not intended to illustrate all possible forms thereof. It will also be understood that the words used are words of description rather than limitation and various changes may be made without departing from the spirit and scope of the invention disclosed.

What is claimed is:

1. A heat exchanger comprising:

a shell including a tubular outer wall having first and second ends, a tubular inner wall coaxial with the outer tubular wall and having first and second ends, and first and second end plates attached to the outer and inner tubular walls to form an enclosed tubular shell cavity therebetween and an enclosed central receiver within the inner wall having first and second ends;

means for communicating between the shell cavity and the central receiver;

means for communicating a first fluid between the exterior of the shell and the shell cavity;

means for communicating the first fluid between the exterior of the heat exchanger and the central receiver; and coil means having first and second ends sealingly exiting through the shell for carrying a second fluid therebetween and spirally wrapped about the inner wall.

2. The heat exchanger of claim 1 wherein:

the means for communicating the first fluid between the exterior of the heat exchanger and the central receiver is a conduit which extends through one of the first or second end plates, the conduit having a first end extending outside the heat exchanger and a second end located within the central receiver.

3. The heat exchanger of claim 2 wherein:

the second end terminates within the central receiver adjacent the end plate opposite the end plate the conduit extends through.

4. The heat exchanger of claim 3 wherein:

the second end of the conduit is beveled at an angle between 30° and 60°.

5. The heat exchanger of claim 4 wherein:

the second end is beveled at an angle of 45°.

6. The heat exchanger of claim 1 wherein:

at least one of the end plates includes an end cap having a planar disk portion and a radial outwardly and axially extending flange, the flange affixing to the inner tubular wall.

7. The heat exchanger of claim 1 wherein the means for communicating between the shell cavity and the central receiver is an orifice in the inner tubular wall.

8. The heat exchanger of claim 7 wherein:

the coil means includes a coil which is coaxially wound about the inner tubular wall, the coil having a first winding and a second winding located adjacent an end plate, the second winding overlying the first winding with an open region being formed between the second winding and the end plate adjacent where the second winding initially overlies the first winding, the orifice in the inner tubular wall being juxtaposed the open region.

9. The heat exchanger of claim 1 wherein:

the communication means providing communication between the shell cavity and the central receiver is a single orifice.

10. A heat exchanger comprising:

an annular outer shell defining an enclosed shell cavity;

a coil located within the shell cavity and having first and second ends sealing extending through the outer shell so that a first fluid can pass through the coil;

an inlet/outlet means for providing fluid communication between the exterior of the outer shell and the enclosed shell cavity;

a cylindrical receiver defining an enclosed receiver cavity and having first and second axially spaced apart ends;

communication means providing communication between the shell cavity and the receiver cavity and disposed adjacent the first end of the receiver; and an inlet/outlet means for providing communication between the outside of the receiver and the receiver cavity, the inlet/outlet means extending through the second end of the receiver;

wherein the first fluid can pass through the coil in the shell cavity and a second fluid can pass through the receiver cavity and the shell cavity so that heat may be exchanged between the first and second fluids.

11. The heat exchanger of claim 10 wherein:

the receiver has a greater volume to store the second fluid than the shell cavity with the coil located therein.

12. The heat exchanger of claim 10 wherein:

the receiver and the outer shell share a common wall with an orifice being formed in the common wall to provide fluid communication between the shell cavity and the receiver cavity.

13. The heat exchanger of claim 10 wherein:

the outer shell is an annular cylinder and the receiver is a cylinder located radially within the annular cylinder, the outer shell and the receiver sharing a common cylindrical wall.

14. The heat exchanger of claim 10 wherein:

the communication means providing communication between the shell cavity and the receiver cavity is a single orifice.

* * * * *

UNITED STATES PATENT AND TRADEMARK OFFICE

CERTIFICATE OF CORRECTION

PATENT NO. : 5,379,832
DATED : January 10, 1995
INVENTOR(S) : Jack C. Dampsey

It is certified that error appears in the above-indentified patent and that said Letters Patent is hereby corrected as shown below:

Column 13, line 24, "120" should be --.120 --.

Signed and Sealed this

Fourth Day of April, 1995

*Attest:*

Bruce Lehman

BRUCE LEHMAN

*Attesting Officer*

*Commissioner of Patents and Trademarks*